US010780441B2

(12) United States Patent
Balvanz

(10) Patent No.: US 10,780,441 B2
(45) Date of Patent: Sep. 22, 2020

(54) PRODUCTION PLUS HAMMER TIP

(71) Applicant: Loran R. Balvanz, Eldora, IA (US)

(72) Inventor: Loran R. Balvanz, Eldora, IA (US)

(73) Assignee: BELLOTA AGRISOLUTIONS AND TOOLS USA, LLC, Rock Island, IL (US)

( * ) Notice: Subject to any disclaimer, the term of this patent is extended or adjusted under 35 U.S.C. 154(b) by 320 days.

(21) Appl. No.: 14/708,945

(22) Filed: May 11, 2015

(65) Prior Publication Data

US 2015/0328641 A1 Nov. 19, 2015

Related U.S. Application Data

(60) Provisional application No. 61/993,335, filed on May 15, 2014.

(51) Int. Cl.
*B02C 13/28* (2006.01)

(52) U.S. Cl.
CPC ..... *B02C 13/28* (2013.01)

(58) Field of Classification Search
CPC ..... B02C 13/28
USPC ..... 241/294, 300, 197
See application file for complete search history.

(56) References Cited

U.S. PATENT DOCUMENTS

| | | | | |
|---|---|---|---|---|
| 4,871,119 | A * | 10/1989 | Murata | B02C 13/2804 241/189.1 |
| 5,967,436 | A | 10/1999 | Balvanz et al. | |
| 6,131,838 | A | 10/2000 | Balvanz et al. | |
| 6,364,227 | B1 | 4/2002 | Dorscht | |
| 6,419,173 | B2 | 7/2002 | Balvanz et al. | |
| 6,481,654 | B1 | 11/2002 | Balvanz et al. | |
| 6,494,393 | B1 | 12/2002 | Balvanz et al. | |
| 7,055,770 | B2 * | 6/2006 | Bardos | B02C 13/06 241/189.1 |
| 7,494,080 | B2 * | 2/2009 | Knotts | B02C 13/2804 241/197 |
| 7,959,098 | B2 * | 6/2011 | Doppstadt | B02C 13/28 241/197 |
| 8,113,453 | B2 * | 2/2012 | Bardos | B02C 13/06 241/189.1 |
| 8,857,748 | B2 | 10/2014 | Carson et al. | |
| 2006/0226270 | A1 * | 10/2006 | Kammerer | B02C 18/18 241/197 |
| 2012/0248231 | A1 | 10/2012 | Fredsall | |
| 2013/0277476 | A1 | 10/2013 | Doppstadt et al. | |

* cited by examiner

*Primary Examiner* — Faye Francis
(74) *Attorney, Agent, or Firm* — Levenfeld Pearlstein, LLC

(57) ABSTRACT

A hammer tip for releasable integration with a hammer, used in a size reducing machine. The hammer tip is separated into a production block with a top working edge and a spacer block. The production block and spacer block utilize a saddle back attachment to the hammer. The production block is further supported with a lock ledge integration to the spacer block. The production block with a single top working edge reduces maintenance cost, reduces downtime and improves machine throughput.

12 Claims, 18 Drawing Sheets

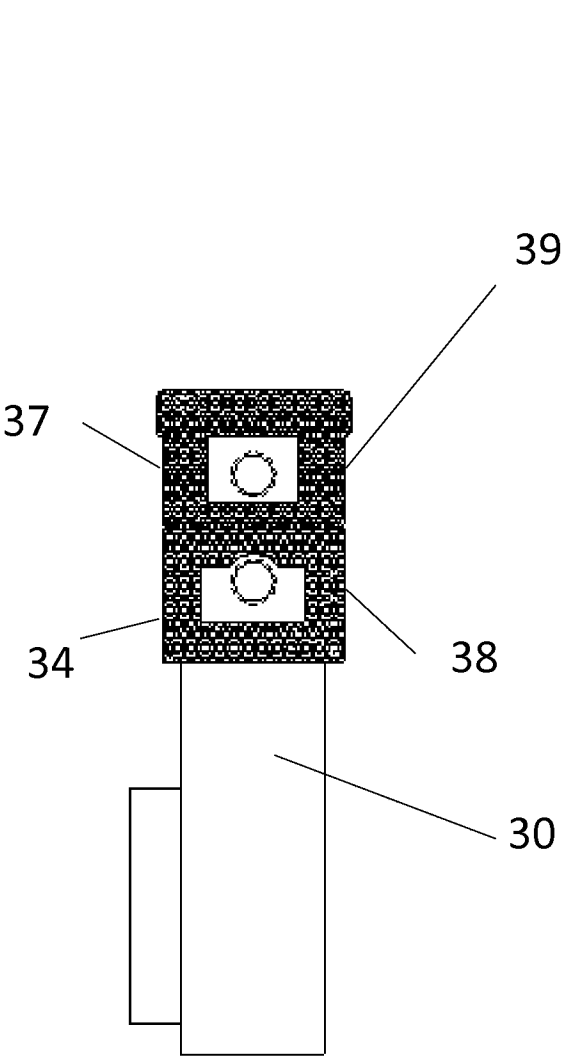
Fig. 3b
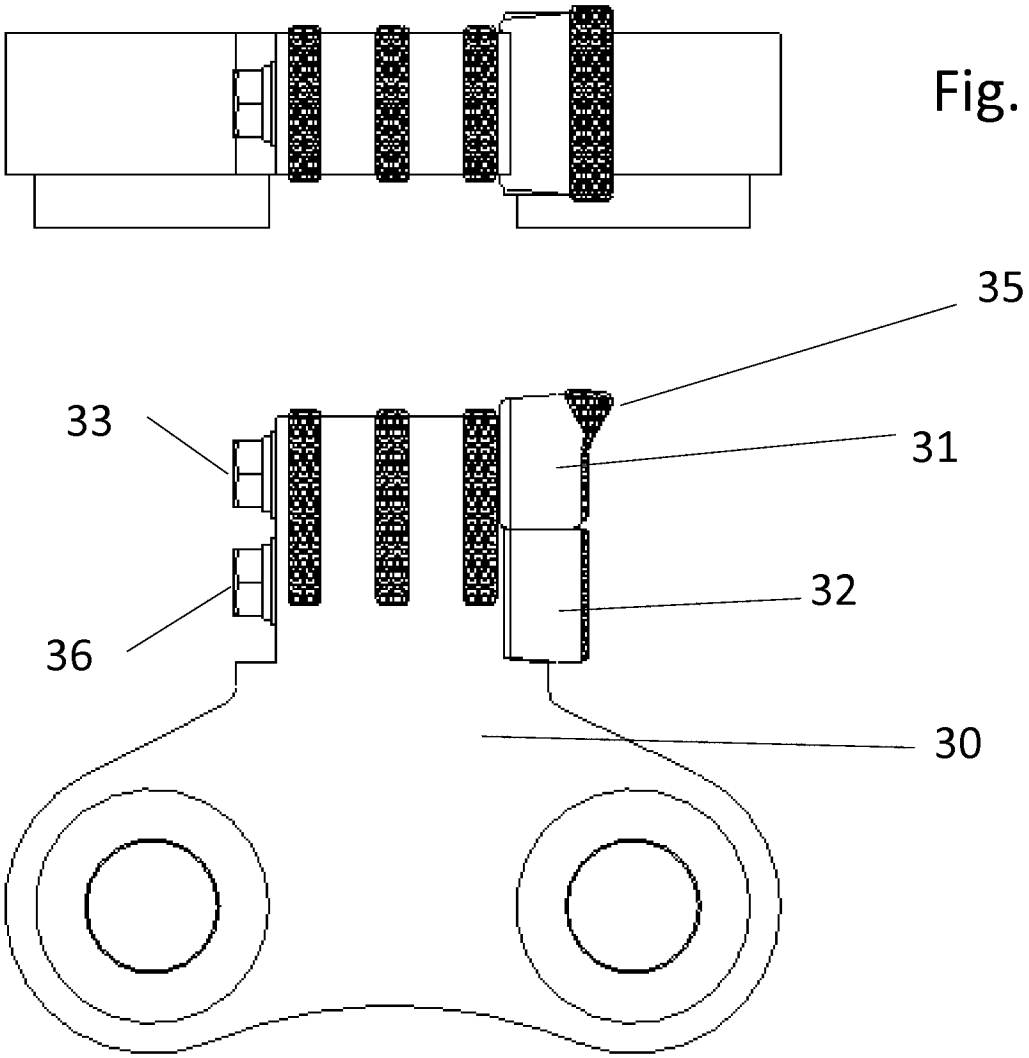
Fig. 3a
Fig. 3c

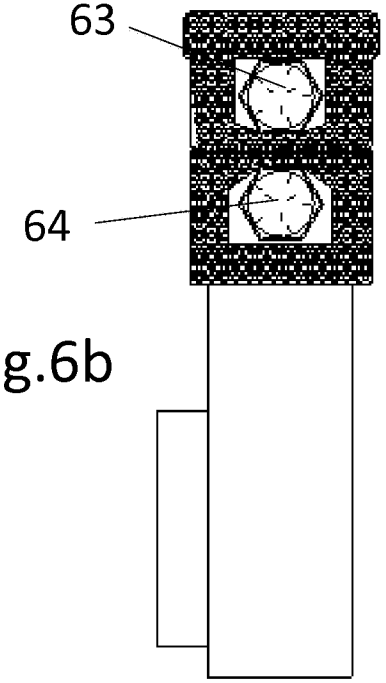
Fig.6b
Fig. 6c
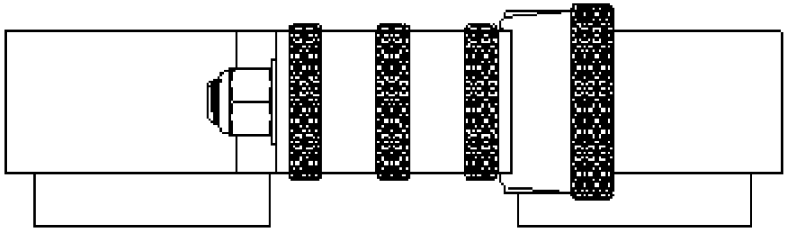
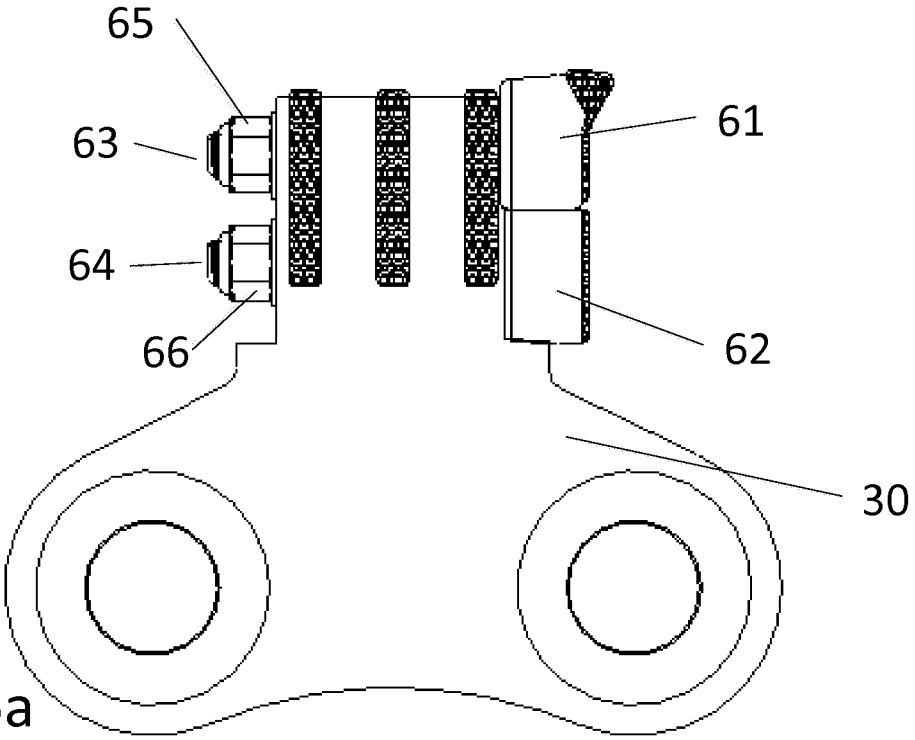
Fig. 6a

Fig. 7c
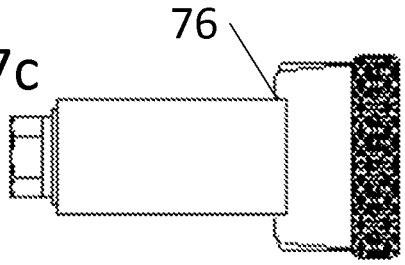
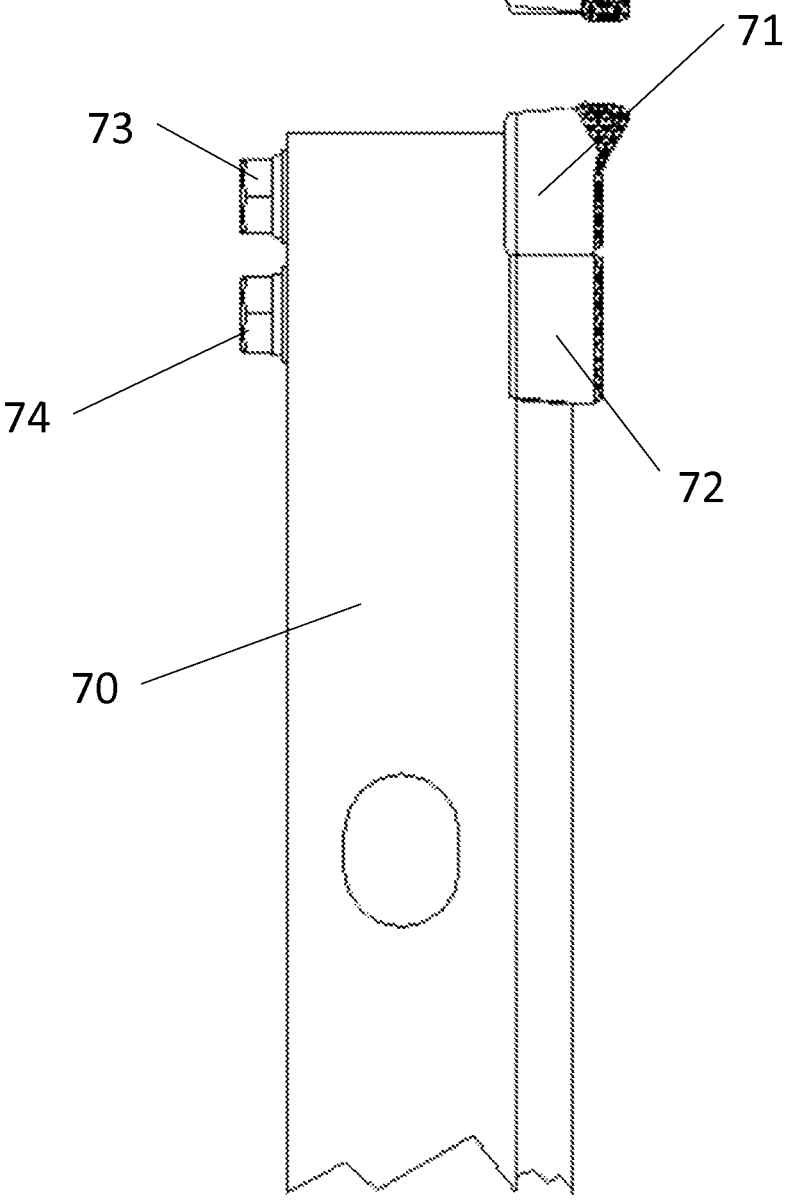
Fig. 7a
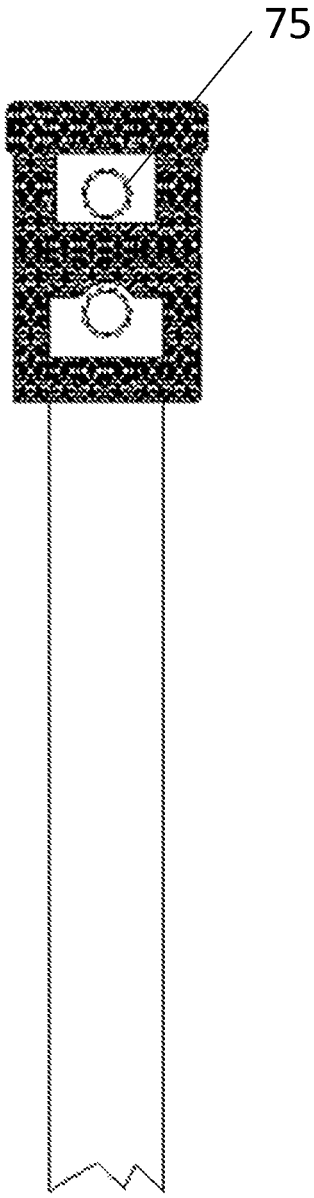
Fig. 7b

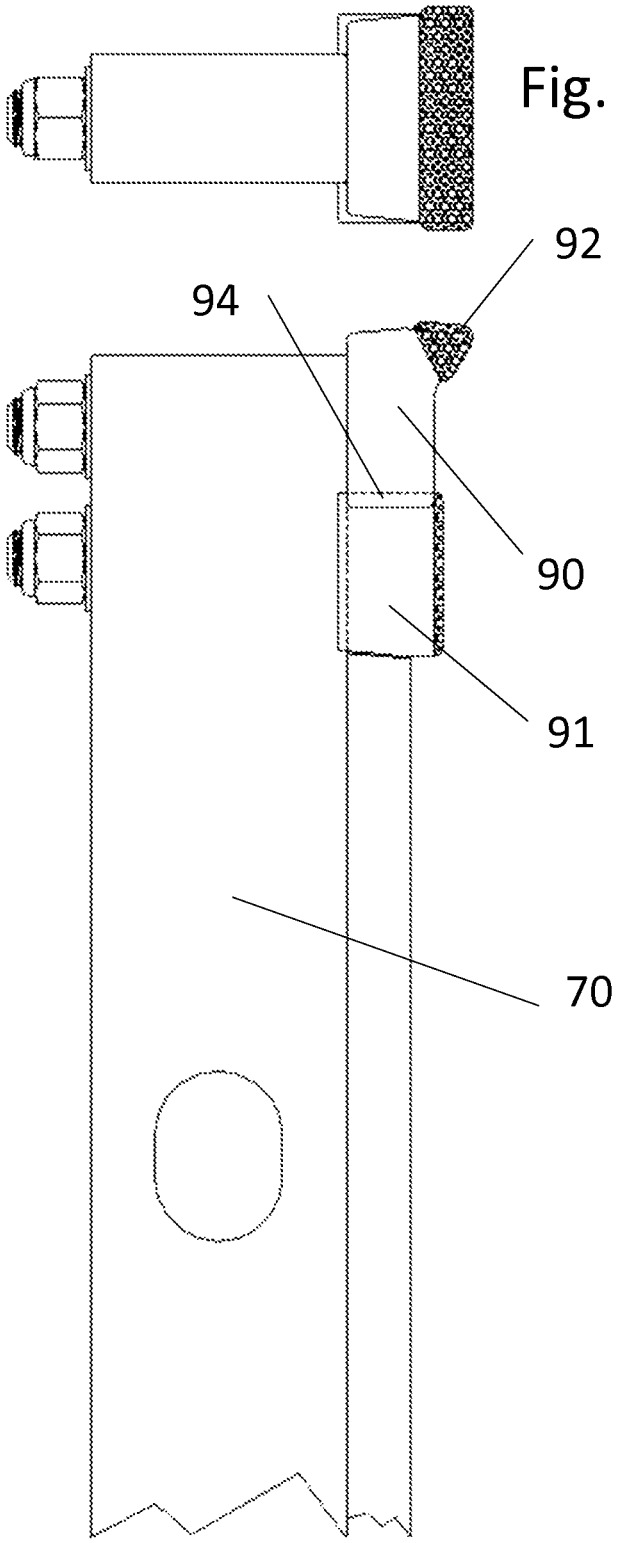
Fig. 9c
Fig. 9a
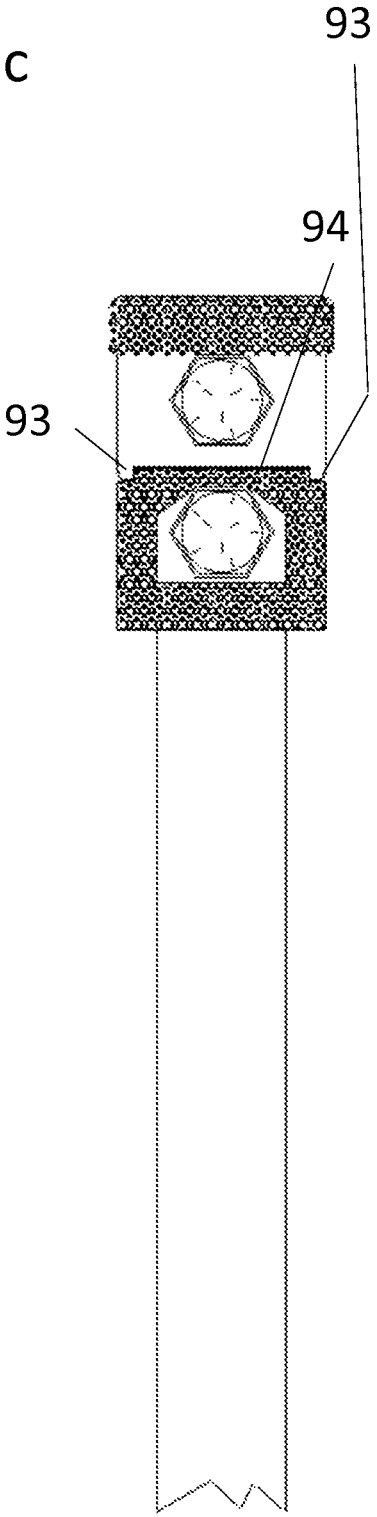
Fig. 9b

Fig. 10c
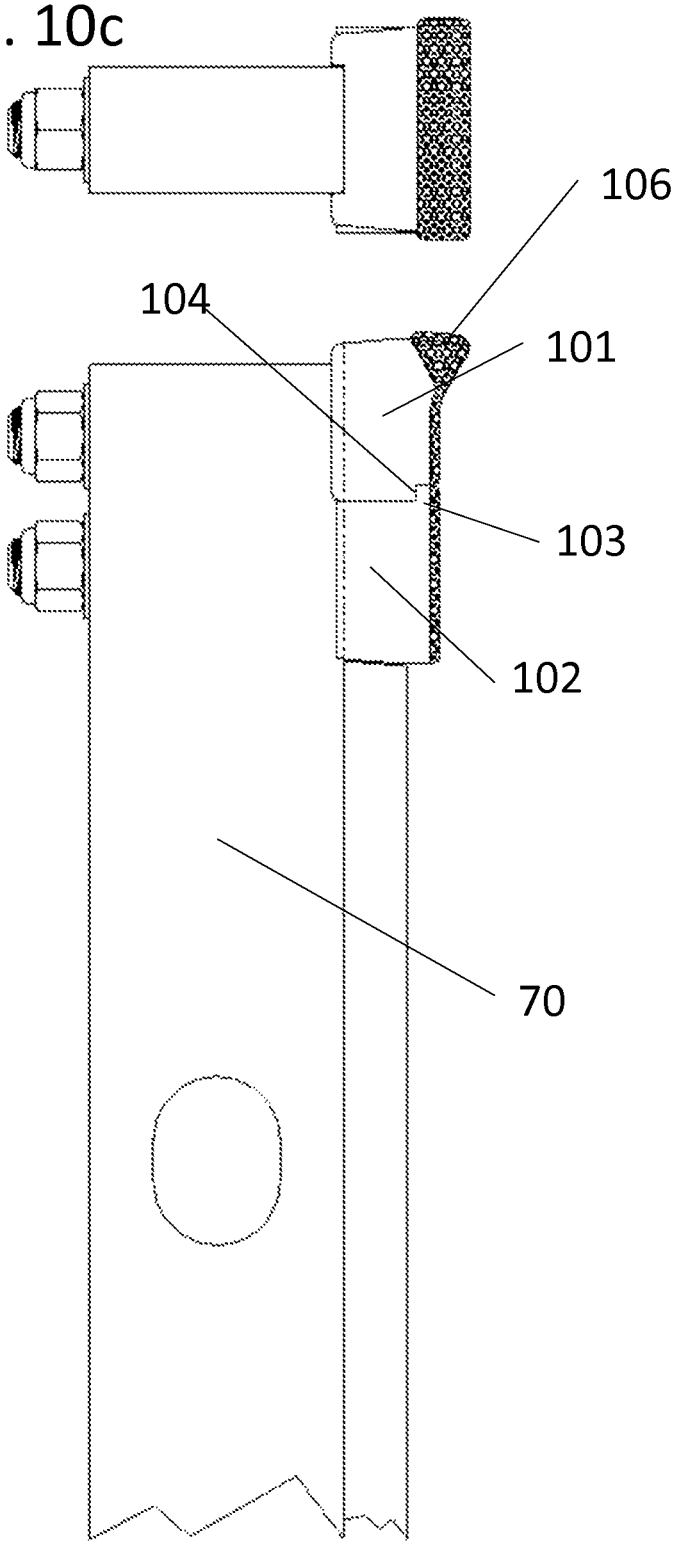
Fig. 10a
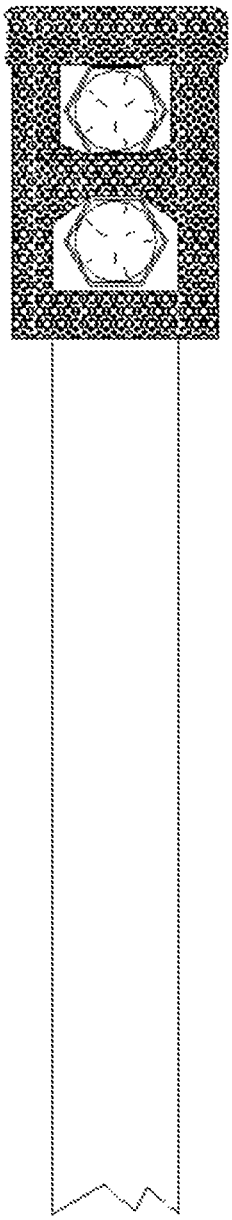
Fig. 10b

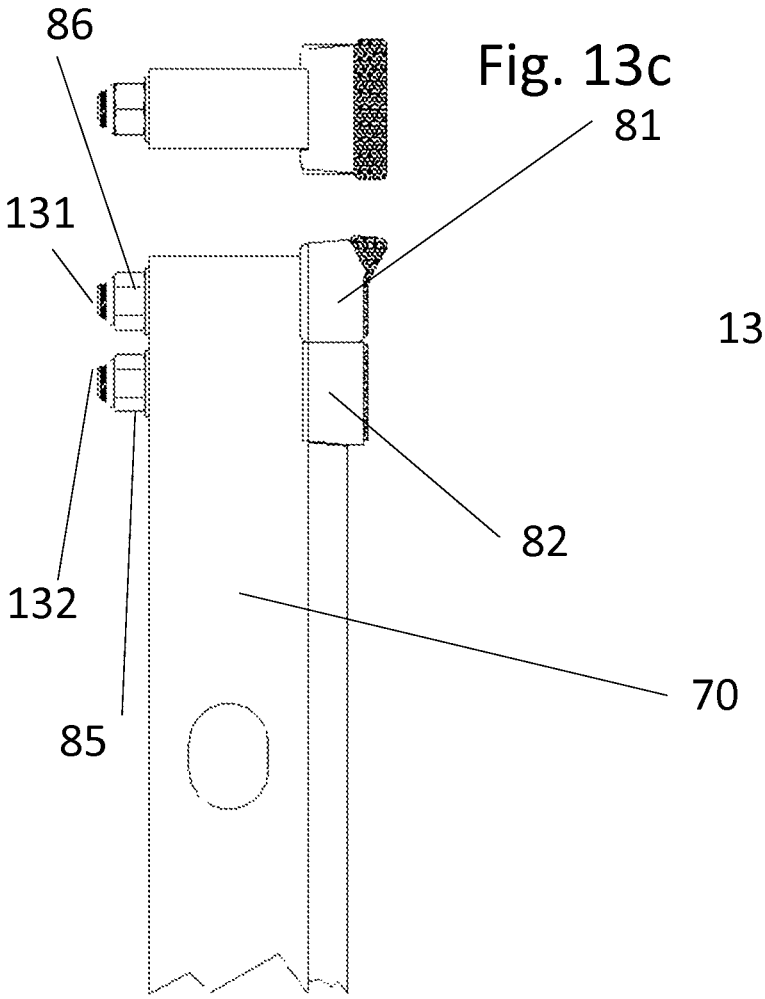
Fig. 13c
Fig. 13a
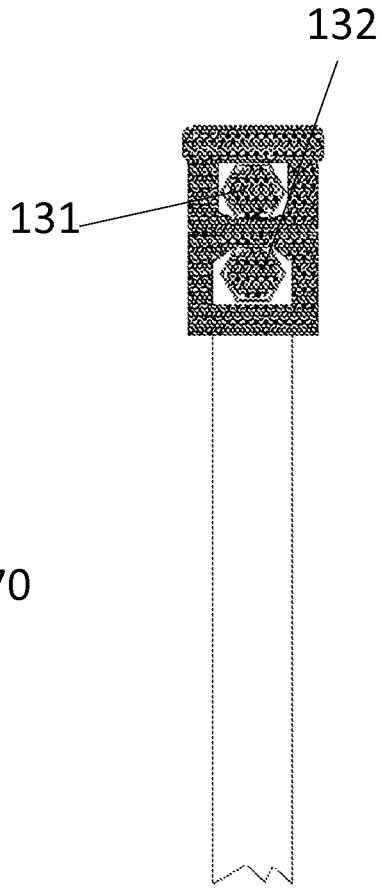
Fig. 13b

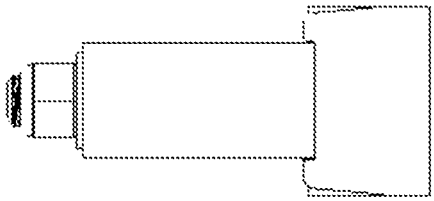
Fig. 15c
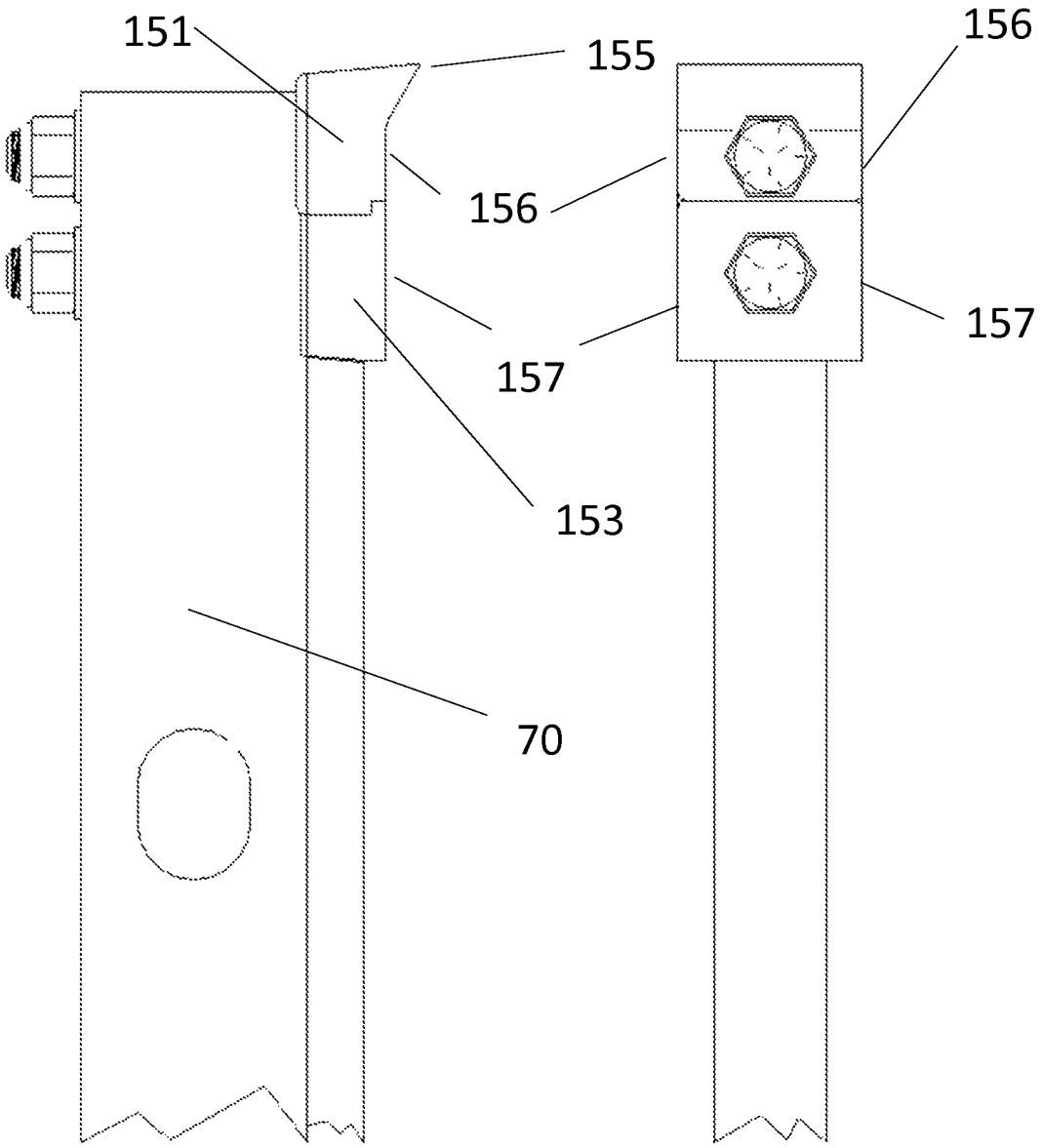
Fig. 15a
Fig. 15b

PRODUCTION PLUS HAMMER TIP

CROSS-REFERENCE TO RELATED APPLICATIONS

This application claims priority to U.S. Provisional Patent Application Ser. No. 61/993,335 filed May 15, 2014, titled "Production Plus Hammer Tip", the entire contents of which is incorporated herein, both bodily and by reference.

FEDERALLY SPONSORED RESEARCH

Not Applicable

SEQUENCE LISTING OR PROGRAM

Not Applicable

FIELD OF THE INVENTION

The present invention relates to a hammer tip for releasable integration with a hammer, used in a size reducing machine.

BACKGROUND OF THE INVENTION

Size reducing machines include rotary hammer mills, tub grinders, vertical and horizontal feed machines and the like. These machines include a plurality of hammers with replaceable hammer tips. Common design practice is for the hammer tips to be symmetrical with two top working edges. It is also common for the hammer tip to be attached to the hammer with two bolts and two nuts. U.S. Pat. No. 6,419,173 granted to Balvantz shows the symmetrical hammer tip and two bolt attachment.

One of the two hammer tip top working edges will encounter the brunt of the action and exhibit the most wear (the up position). The other symmetrical working edge is mostly out the action (the down position) and will exhibit only some wear.

Depending on the location of the hammer tip within the machine, it will exhibit more or less wear than other hammer tips.

During hammermill operation, it is important that the hammer tips are not too worn. Excessively worn hammer tips will reduce the mill operation throughput and increase the machine power consumption. Typically, the hammermill operator will inspect the hammermill tips for wear every 4 hours or as scheduled.

If a hammermill tip top working edge is observed to be worn, the two attachment bolts are removed. Typically in extreme conditions, both bolt heads are also worn and the bolts will be replaced. If both working edges of the hammermill tip are worn, the hammermill tip is replaced. If only one of the hammermill tips is worn, the hammermill tip is rotated end for end and reinstalled.

Because there are twice as many working edges (both ends of each hammer tip) compared to the number of hammers, the operator may try to overly optimize the position of the working edges. This repositioning of the working edges causes excessive downtime.

SUMMARY OF THE INVENTION

The present invention is a hammer tip comprised of two sections. The production block is the upper portion of the hammer tip and includes the top working edge. The spacer block fills the space below the production block and secures the production block positioning. The spacer block also provides additional side working edges and flat front surface with carbide facing.

The maximum amount of working edge (top and side) and flat impact face is desireable for grinding throughput.

One of the objects of the invention is to have a single top working edge for each hammer tip. This simplifies the replacement procedure and eliminates downtime due to excessive repositioning of hammer tips. Replacement of production blocks requires 50% less downtime due to only a single bolt removal. For reassembly, the production block is placed on top of the spacer block. This positioning guide decreases the downtime in lining up the production block and bolt.

Another object of the invention is to increase the throughput of the size reducing machine by increasing the amount of working edge. In addition to the top working edge, there are also side working edges. The spacer block includes two full length side working edges. This is substantially more side working edge compared to a symmetrical hammer tip with two top working edges. The spacer block provides a full flat face that could be fully covered with a wear resistant coating such as Caden Edge. This increase in carbide covered flat face also increases throughput.

Another object of the invention is to reduce the amount of high grade steel material. It is anticipated that the production block would need replacing approximately 10 times before the spacer block would need replacement. By replacing only the worn production block most of the time, a large savings in total usage of high grade steel material is realized. Two production blocks will last substantially longer in machine use than one symmetrical hammer tip. This is because the lower half of the symmetrical hammer tip is partially worn before it is inverted and reinstalled.

Another object of the invention is to reduce the number of replacement bolts and nuts. In one configuration of the invention, the nuts are eliminated with internal threads on the production block or spacer block. In another configuration, the bolt head is protected in the production block or spacer block with a wear resistant coating.

In another configuration of the invention, a saddle back shoulder is used to resist movement of the production block or spacer block relative to the hammer. This saddle back is important for secure attachment of these parts with a single bolt.

In another configuration of the invention, a locking ledge is used between the production plus block and support block.

BRIEF DESCRIPTION OF THE DRAWINGS

FIG. 3*a* is a side view of a production plus hammer assembly with bolts.

FIG. 3*b* is a front view of a production plus hammer assembly with bolts.

FIG. 3*c* is a top view of a production plus hammer assembly with bolts.

FIG. 6*a* is a side view of a production plus hammer assembly with nuts.

FIG. 6*b* is a front view of a production plus hammer assembly with nuts.

FIG. 6*c* is a top view of a production plus hammer assembly nuts.

FIG. 7*a* is a side view of a production plus bar hammer assembly with bolts.

FIG. 7*b* is a front view of a production plus bar hammer assembly with bolts.

FIG. 7*c* is a top view of a production plus bar hammer assembly with bolts.

FIG. 9*a* is a side view of a production plus bar hammer assembly with side saddle.

FIG. 9*b* is a front view of a production plus bar hammer assembly with side saddle.

FIG. 9*c* is a top view of a production plus bar hammer assembly with side saddle.

FIG. 10*a* is a side view of a production plus bar hammer assembly with lock ledge.

FIG. 10*b* is a front view of a production plus bar hammer assembly with lock ledge.

FIG. 10*c* is a top view of a production plus bar hammer assembly with lock ledge.

FIG. 13*a* is a side view of a production plus bar hammer assembly with Caden Edge bolt head.

FIG. 13*b* is a front view of a production plus bar hammer assembly with Caden Edge bolt head.

FIG. 13*c* is a top view of a production plus bar hammer assembly with Caden Edge bolt head.

FIG. 15*a* is a side view of a production plus bar hammer assembly with sharp edge.

FIG. 15*b* is a front view of a production plus bar hammer assembly with sharp edge.

FIG. 15*c* is a top view of a production plus bar hammer assembly with sharp edge.

REFERENCE NUMERALS

| | | | |
|---|---|---|---|
| 10 | grinder housing | 11 | drum |
| 12 | rotation direction | 13 | hammer |
| 15 | hammer tip | 16 | distal working edge |
| 17 | distal working edge | 18 | nose |
| 20 | bolt | 21 | bolt |
| 22 | proximal working edge | 23 | bolt pocket |
| 25 | nut | 26 | nut |
| 28 | wear resistant surface | 29 | proximal working edge |
| 30 | hammer | 31 | production block |
| 32 | support block | 33 | bolt |
| 34 | side working edge | 35 | top working edge |
| 37 | side working edge | 38 | side working edge |
| 39 | side working edge | 42 | internal thread |
| 44 | saddle back | 45 | saddle back |
| 46 | wear resistant surface | 52 | internal thread |
| 53 | saddle back | 54 | saddle back |
| 61 | production block | 62 | spacer block |
| 63 | bolt | 64 | bolt |
| 65 | nut | 66 | nut |
| 70 | bar hammer | 71 | production block |
| 72 | spacer block | 73 | bolt |
| 74 | bolt | 75 | internal thread |
| 76 | saddle back | 81 | production block |
| 82 | spacer block | 83 | bolt |
| 85 | nut | 86 | nut |
| 87 | saddle back | 90 | production block |
| 91 | spacer block | 92 | top working edge |
| 93 | side saddle back | 94 | saddle |
| 101 | production block | 102 | spacer block |
| 103 | lock ledge | 104 | lock pocket |
| 111 | saddle back | 126 | saddle back |
| 131 | bolt | 132 | bolt |
| 141 | worn production block | 143 | worn top working edge |
| 145 | top working edge | 151 | sharp edge production block |
| 153 | sharp edge spacer block | 155 | top working edge |
| 156 | side working edge | 157 | side working edge |
| 160 | production block | 161 | side working edge |
| 163 | top working edge | 171 | sweep |
| 172 | sweep attachment | 173 | bottom Caden Edge |
| 174 | nose | 175 | nose Caden Edge |
| 181 | sweep | 182 | sweep attachement |
| 183 | nose Caden Edge | 184 | shank Caden Edge |
| 185 | bottom Caden Edge | | |

DETAILED DESCRIPTION

Figure 1:
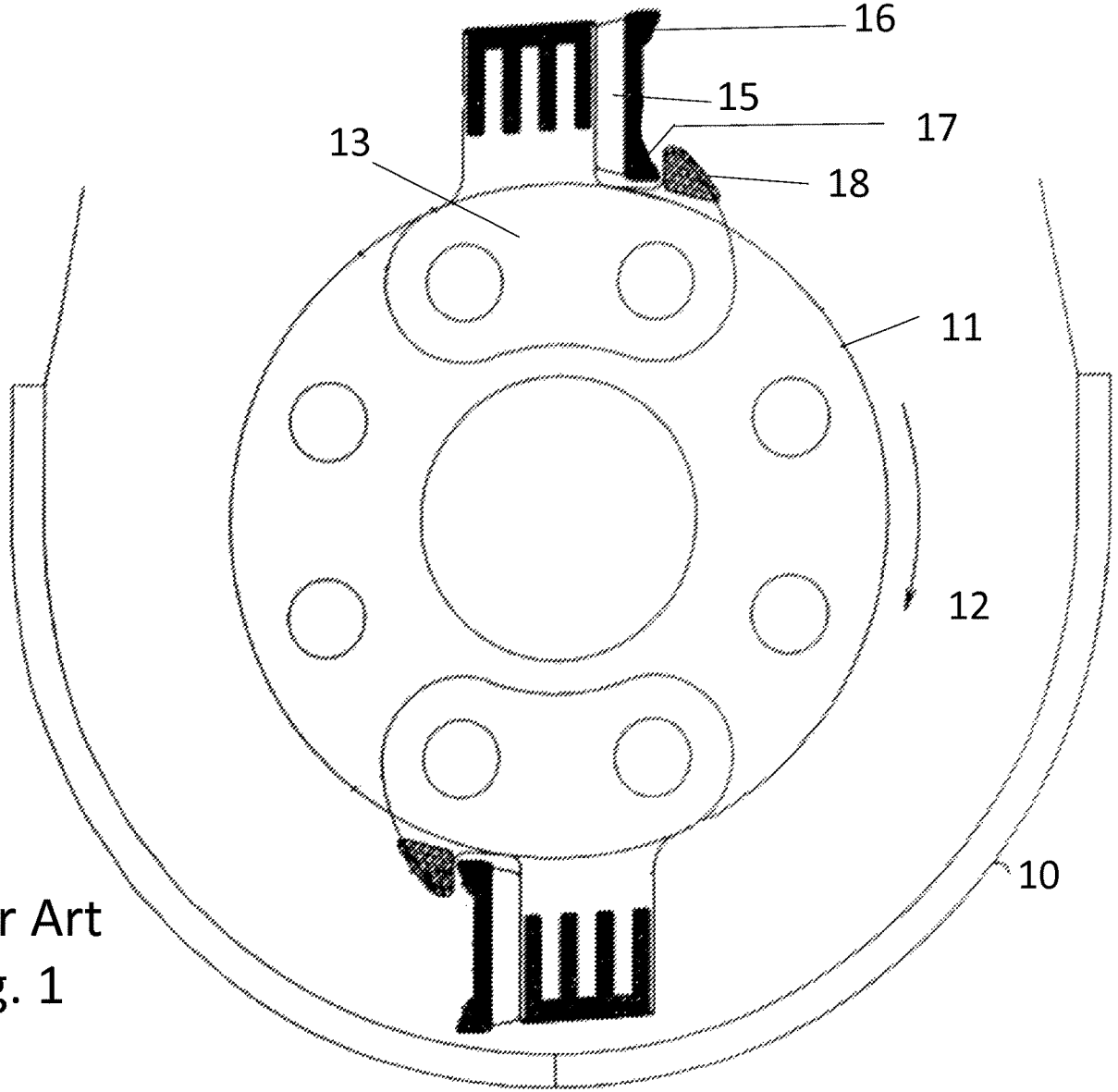
Prior Art Fig. 1
FIG. 1 is a prior art side view of a grinding machine assembly.

FIG. 1 is a prior art side view of a grinding machine assembly. The grinder housing 10 is stationary. The drum 11 is powered and has rotation direction 12. The hammer 13 is affixed to the drum 11.

Figure 2B:
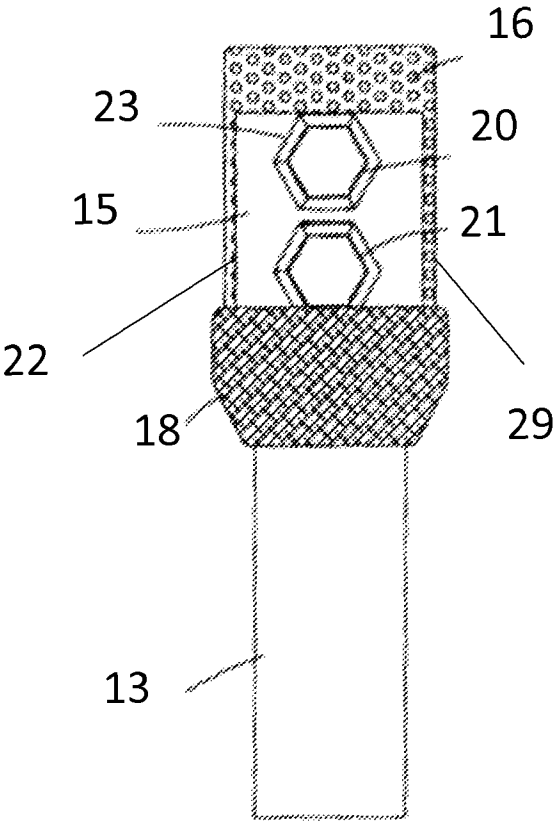
Prior Art Fig. 2b
FIG. 2*b* is a prior art front view of a hammer assembly.
Figure 2A:
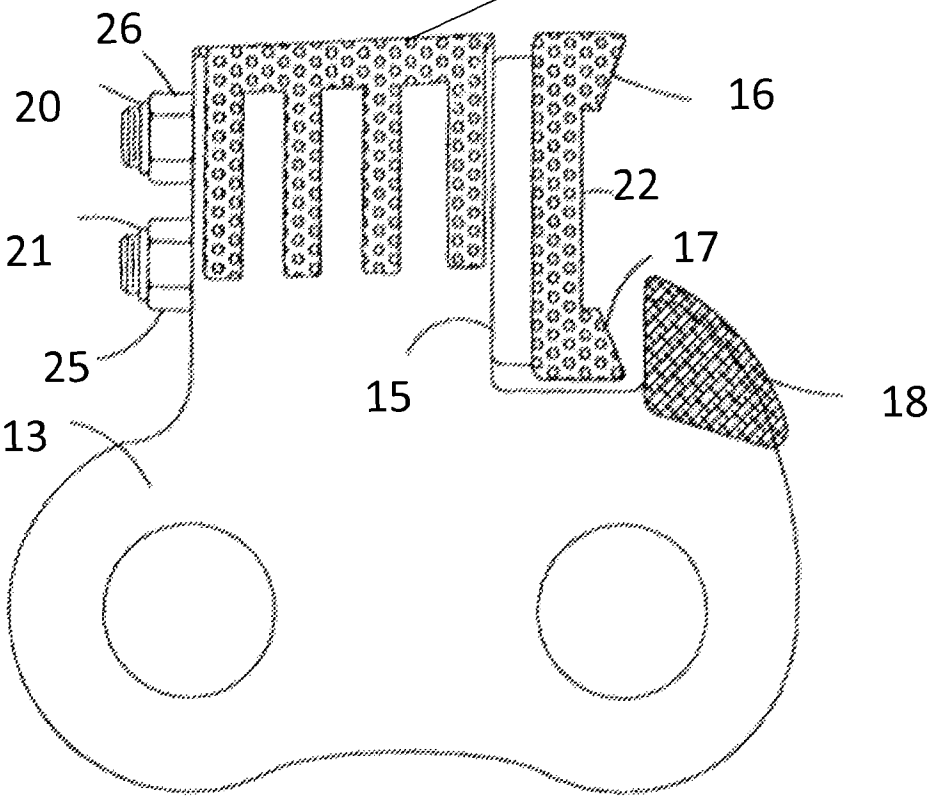
Prior Art Fig. 2a
FIG. 2*a* is a prior art side view of a hammer assembly.

FIG. 2*a* is a prior art side view of a hammer assembly. The hammer tip 15 is affixed to the hammer 13 with bolt 21, bolt 20, nut 25 and nut 26. A bolt pocket 23 is incorporated into the hammer tip 15. The hammer tip 15 includes distal working edge 16, distal working edge 17, proximal working edge 22 and proximal working edge 29.

The nose 18 incorporated into the hammer 13 is intended to protect the distal working edge 17 from wear while in this position. After several hours of grinder operation, the distal working edge 16 would experience wear to the point that the grinder throughput is decreased. Then bolt 20 and bolt 21 would be removed, the hammer tip 15 would be inverted and the bolts replaced.

A wear resistant surface 28 such as Caden Edge is shown on the nose 18, hammer tip 15 and the top of the hammer 15.

FIG. 2*b* is a prior art front view of a hammer assembly. The working surfaces are all the rotating edges that provide grinding action. Note that as shown in FIG. 2*b*, the working surfaces include distal working edge 16 and approximately half of proximal working edge 22 and proximal working edge 29. The nose 18 is blunt and provides little working surface. The nose 18 also shields distal working edge 17 and approximately half of the proximal working edges.

FIG. 3*a* is a side view of a production plus hammer assembly with bolts. The hammer 30 no longer includes the nose 18 feature. The production plus hammer tip includes the production block 31 and the spacer block 32. The production plus hammer tip could be installed on the hammer 13, however the nose 18 would be vestigial feature.

The production block 31 and spacer block 32 are affixed to the hammer 30 with bolt 33 and bolt 36. The production block 31 and spacer block 32 include clearance holes for bolt 33 and bolt 36. Note how the surface plane between the production block 31 and spacer block 32 allow each of the blocks to provide support for the other.

FIG. 3*b* is a front view of a production plus hammer assembly with bolts. The production block 31 includes working surfaces top working edge 35, side working edge 37 and side working edge 39. The spacer block includes working surfaces side working edge 34 and side working edge 38. Note that all of side working edge 37 and side working edge 39 are working surfaces. Also note that a high percentage of side working edge 34 and side working edge 38 are working surfaces.

Figure 4B:
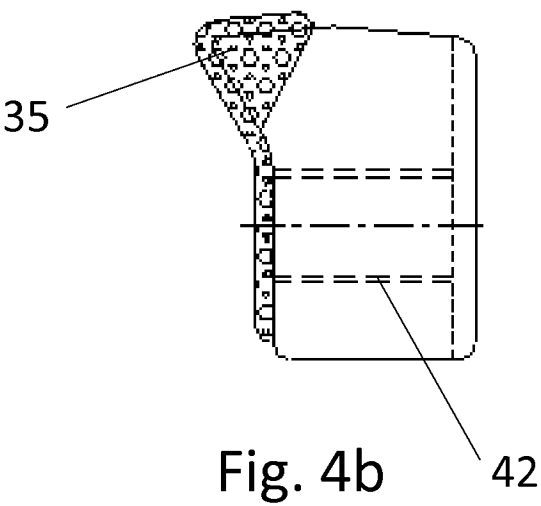
FIG. 4*b* is a side view of a production block with saddle back.
Figure 4A:
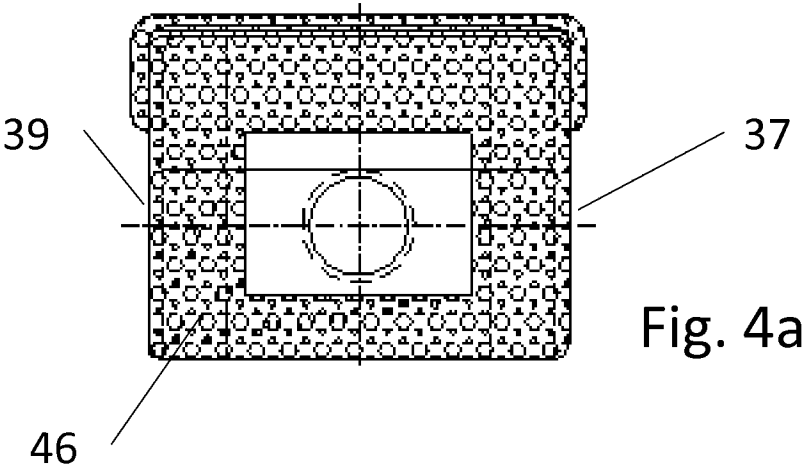
FIG. 4*a* is a front view of a production block with saddle back.

FIG. 4*a* is a front view of a production block with saddle back. A wear resistant surface 46 such as Caden Edge is shown on the top working edge 35, side working edge 39, side working edge 37 and all of the face except near the internal thread 42.

FIG. 4*b* is a side view of a production block with saddle back. The internal thread 42 is used by the bolt 33 to attach the production block 31 to the hammer 30.

Figure 4C:
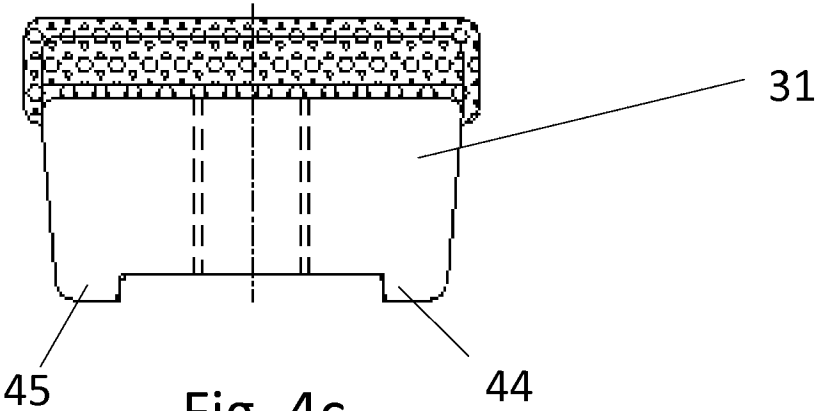
FIG. 4*c* is a bottom view of a production block with saddle back.

FIG. 4*c* is a bottom view of a production block with saddle back. The saddle back 44 and saddle back 45 provide rotation resistance of the production block relative to the hammer 30.

Figure 5B:
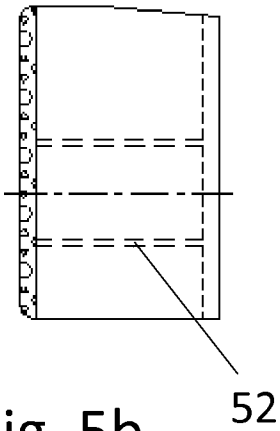
FIG. 5*b* is a side view of a spacer block with saddle back.
Figure 5A:
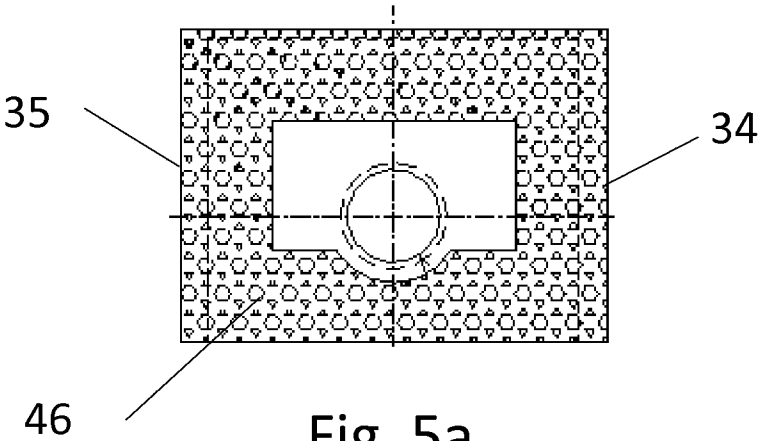
FIG. 5*a* is a front view of a spacer block with saddle back.

FIG. 5*a* is a front view of a spacer block with saddle back. A wear resistant surface 46 such as Caden Edge is shown on the side working edge 35, side working edge 34 and all of the face except near the internal thread 52.

FIG. 5*b* is a side view of a spacer block with saddle back. The internal thread 52 is used by the bolt 36 to attach the spacer block 32 to the hammer 30.

Figure 5C:
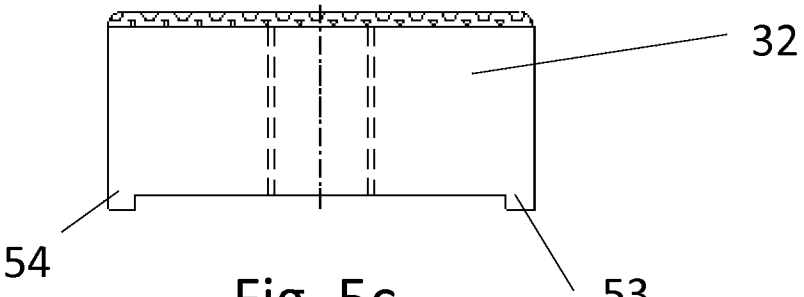
FIG. 5*c* is a top view of a spacer block with saddle back.

FIG. 5*c* is a top view of a spacer block with saddle back. The saddle back 54 and saddle back 53 provide rotation resistance of the spacer block relative to the hammer 30.

FIG. 6*a* is a side view of a production plus hammer assembly with nuts. The production plus hammer tip includes the production block 61 and the spacer block 62. The production block 61 is affixed to the hammer 30 with bolt 63 and nut 65. The spacer block 62 is affixed to the hammer 30 with bolt 64 and nut 66.

FIG. 6*b* is a front view of a production plus hammer assembly with nuts. The production block would include a feature such as bolt pocket 23 to prevent rotation of bolt 63. The spacer block 62 would include a feature such as bolt pocket 23 to prevent rotation of bolt 64.

FIG. 7*a* is a side view of a production plus bar hammer assembly with bolts. The bar hammer 70 provides a similar function to the hammer 30. The bar hammer 70 is affixed to a drum 11 and provides attachment means for the production plus hammer tip. The production block 71 and spacer block 72 are affixed to the bar hammer 70 with bolt 73 and bolt 74.

Figure 8C:
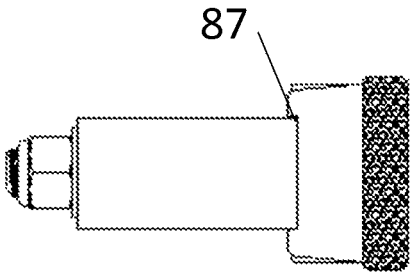
FIG. 8*c* is a top view of a production plus bar hammer assembly with nuts.
Figure 8A:
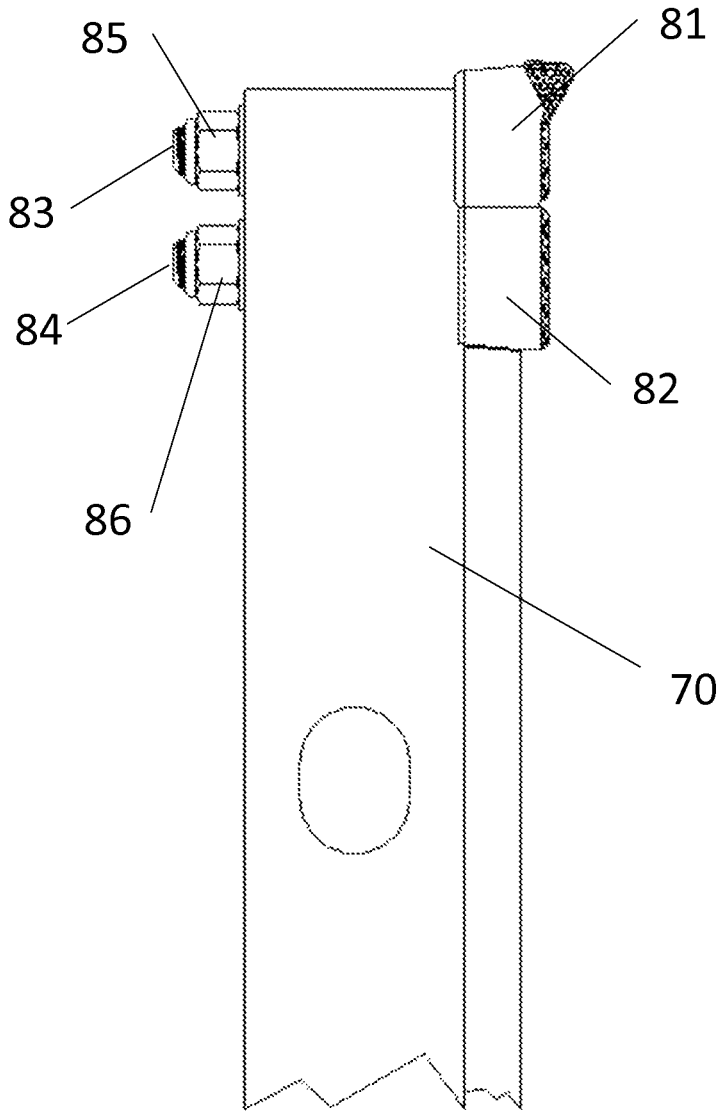
FIG. 8*a* is a side view of a production plus bar hammer assembly with nuts.

FIG. 8*a* is a side view of a production plus bar hammer assembly with nuts. The production block 81 is affixed to the bar hammer 70 with bolt 83 and nut 85. The spacer block 82 is affixed to the bar hammer 70 with bolt 84 and nut 86.

FIG. 9*a* is a side view of a production plus bar hammer assembly with side saddle. The spacer block 91 includes a saddle back feature with the bar hammer 70 to resist rotational movement. The spacer block 91 also includes a saddle 94 feature which protrudes above the upper surface.

FIG. 9*b* is a front view of a production plus bar hammer assembly with side saddle. The production block 90 includes two side saddle 93 features. These mate with the saddle 94 and resist rotational movement of the production block 90. As shown in FIG. 9*a*, the production block 90 does not include a saddle back feature, since rotational movement is covered by the side saddle.

FIG. 10*a* is a side view of a production plus bar hammer assembly with lock ledge, and FIGS. 10*b* and 10*c* are front and top views, respectively, of the production plus bar hammer assembly with lock ledge. In this configuration, both the production block 101 and spacer block 102 include saddle back features. In addition, the spacer block 102 includes a lock ledge 103. The production block 101 includes a lock pocket 104. The lock ledge 103 prevents tilting motion of the production block 101. This tilting motion is caused by the impact of grinding material against the top working edge 106.

Figure 11A:
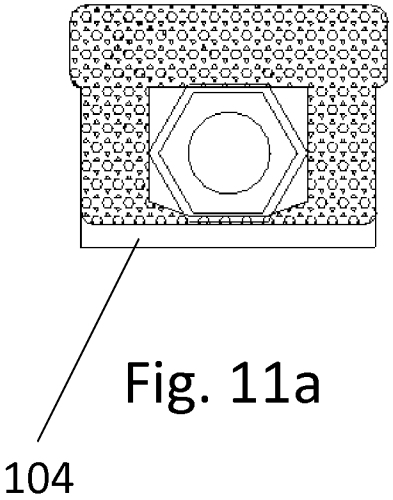
FIG. 11*a* is a front view of a production block with lock pocket.
Figure 11B:
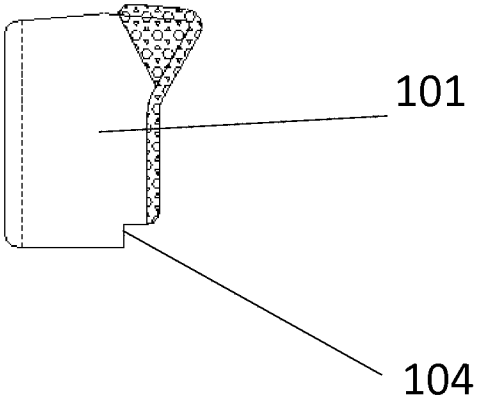
FIG. 11*b* is a side view of a production block with lock pocket.

FIG. 11*a* is a front view, and FIG. 11*b* is a side view, of a production block with lock pocket. The lock pocket 104 is recessed into the front of the production block along the width of the front side of the production block. The lock pocket 104 and lock ledge 103 are precision machined to tightly fit.

Figure 11C:
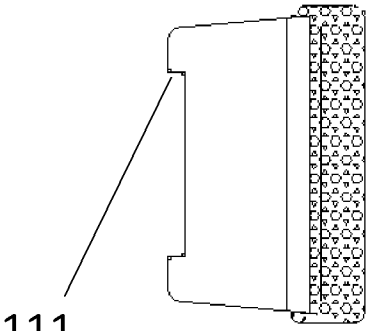
FIG. 11*c* is a bottom view of a production block with lock pocket.

FIG. 11*c* is a bottom view of a production block with lock pocket. Note the saddle back 111 on the back of the part.

Figure 12A:
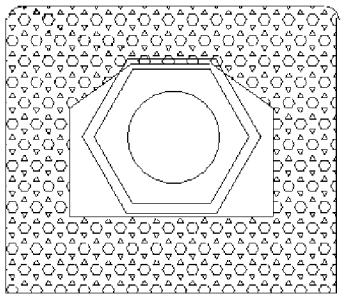
FIG. 12*a* is a front view of a spacer block with lock ledge.
Figure 12B:
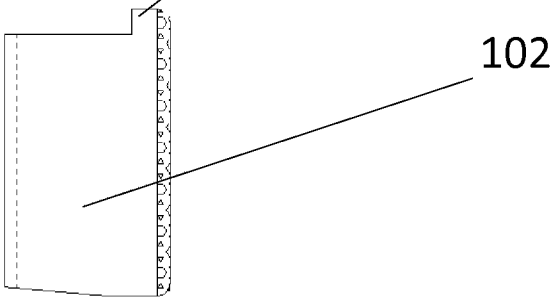
FIG. 12*b* is a side view of a spacer block with lock ledge.

FIG. 12*a* is a front view, and FIG. 12*b* is a side view of a spacer block with lock ledge. The lock ledge 103 is formed as a ledge along the width of the back side of the spacer block and holds the bottom of the production block against the bar hammer 70.

Figure 12C:
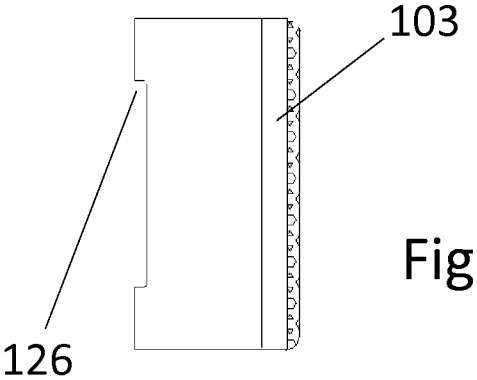
FIG. 12*c* is a top view of a spacer block with lock ledge.

FIG. 12*c* is a top view of a spacer block with lock ledge. Note the saddle back 126 on the back of the part.

FIG. 13*a* is a side view of a production plus bar hammer assembly with Caden Edge bolt head. This is similar construction to FIG. 8*a* with the exception of the bolts.

Figure 8B:
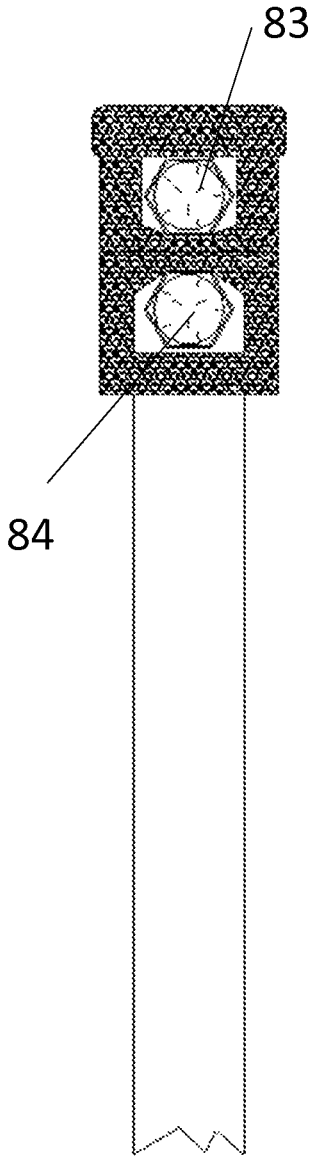
FIG. 8*b* is a front view of a production plus bar hammer assembly with nuts.

FIG. 13*b* is a front view of a production plus bar hammer assembly with Caden Edge bolt head. During operation, the impact of material on the production plus hammer tip causes wear on any forward facing surface. The high impact surfaces of the production block 81 and spacer block 82 are covered with a wear resistant coating. As shown in FIG. 8*b*, the heads of bolt 83 and bolt 84 are subject to high wear. As shown in FIG. 13*b*, the heads of bolt 131 and bolt 132 are covered with a wear resistant coating such as Caden Edge.

In configuration A of FIG. 13*b* the head of bolt 131 would have the wear resistant coating applied before assembly to production block 81. This would keep the most flexibility in assembly/disassembly of the production block 81 to the bar hammer 70.

In configuration B of FIG. 13*b* the head of bolt 131 would have the wear resistant coating applied after assembly to production block 81. The application of the wear resistant coating such as Caden Edge would permanently capture the bolt 131 to the production block 81. The head of the bolt 131 would be welded to the bolt pocket 23 of the production block 81. It is important that the bolt 131 be accurately aligned with the production block 81 during the welding (Caden Edge) process to facility assembly to the bar hammer 70. It is possible with this configuration for the entire face (all front surface of production block 81 and bolt 131 head) to be covered with the wear resistant coating such as Caden Edge.

Configurations A or B would also have applicability to spacer block 82 and bolt 132.

Figure 14:
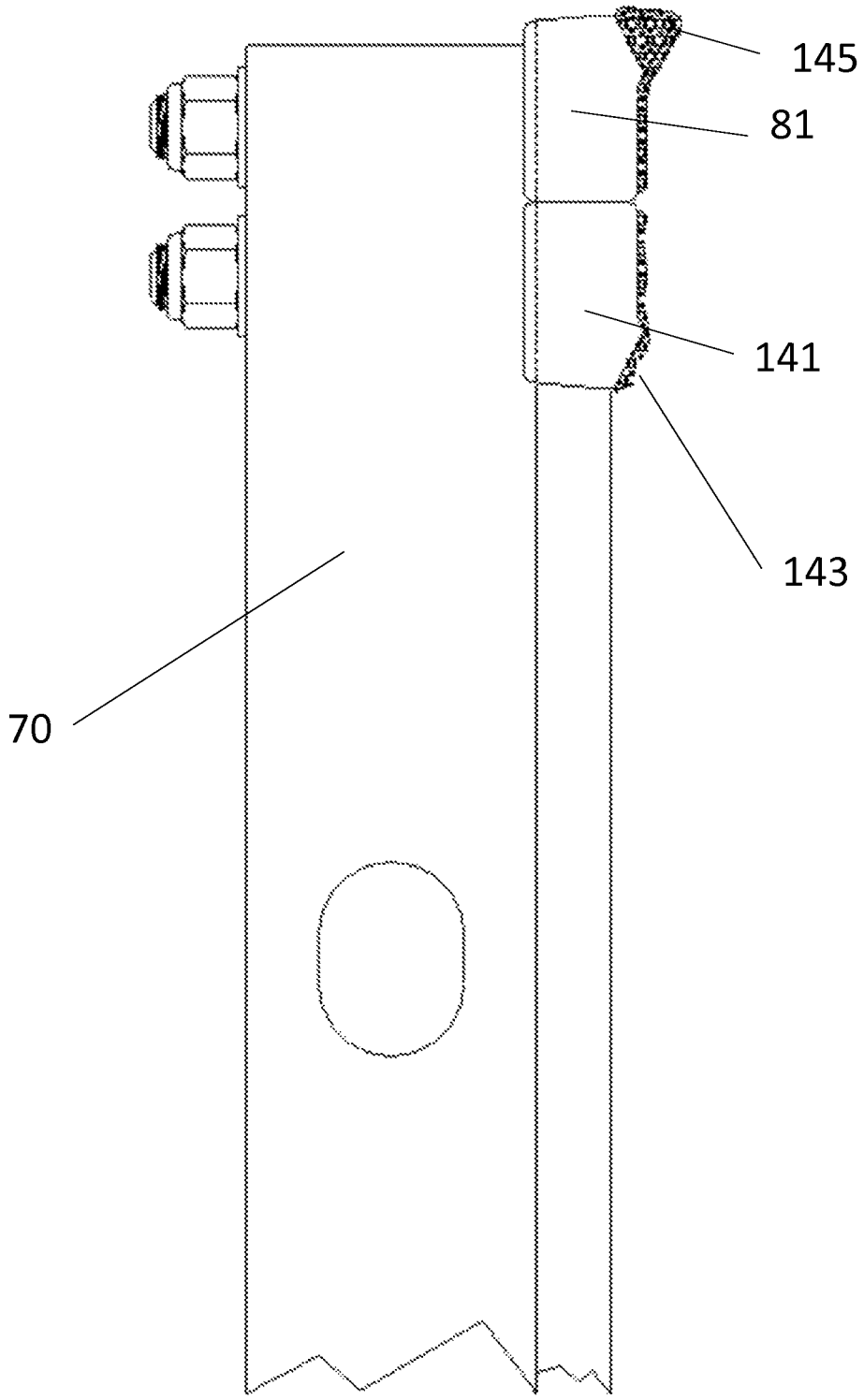
FIG. 14 is a side view of a production plus bar hammer assembly with worn production spacer.

FIG. 14 is a side view of a production plus bar hammer assembly with worn production spacer. A spacer block 62 will wear at about 1/10 the rate of the production block 81. In a production environment, there will be an excess of worn production blocks 141. With the correct geometry, it is possible to allow worn production blocks 141 to be used as replacement spacer blocks 62. The worn production block 141 is rotated and placed with the worn top working edge 143 at the bottom.

The correct geometry includes: a. not having the lock ledge feature b. not having the side saddle feature and c. both blocks having the same distance from bolt centerline to production block/spacer block contact surface.

FIG. 15*a* is a side view of a production plus bar hammer assembly with sharp edge. The sharp edge production block 151 includes a top working edge 155 and two side working edges 156. The sharp edge spacer block 153 includes two side working edges 157. For good wear resistance, the working edges and front face of sharp edge production block 151 and sharp edge spacer block 153 could be hardened to approximately HRC 60. These blocks could also have a thin wear resistant coating of carbide spray applied.

Figure 16B:
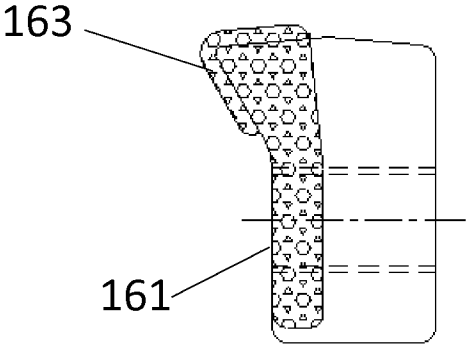
FIG. 16*b* is a side view of a production block with side Caden Edge.
Figure 16A:
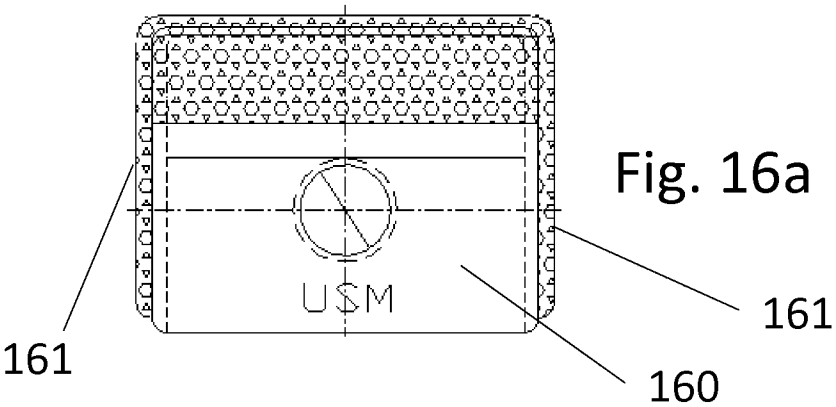
FIG. 16*a* is a front view of a production block with side Caden Edge.
Figure 16C:
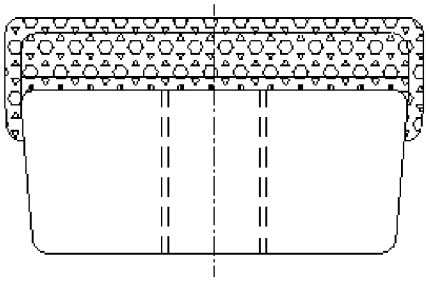
FIG. 16*c* is a bottom view of a production block with side Caden Edge.

FIG. 16*a* is a front view of a production block with side Caden Edge. The production block 160 includes wear resistant coating such as Caden Edge on the top working edge 163 and two side working edges 161.

Figure 17B:
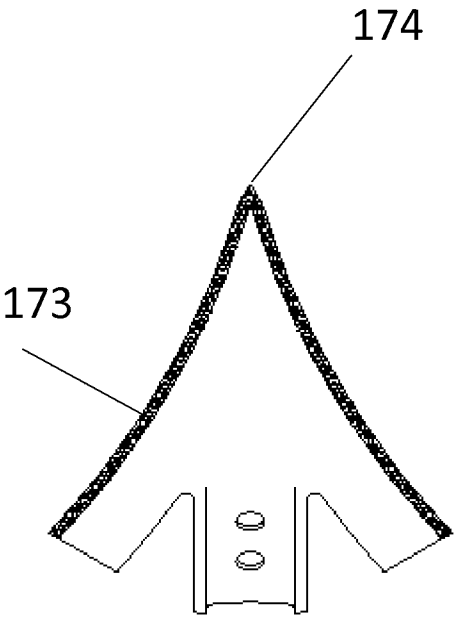
FIG. 17*b* is a bottom view of a sweep with nose point Caden Edge.
Figure 17A:
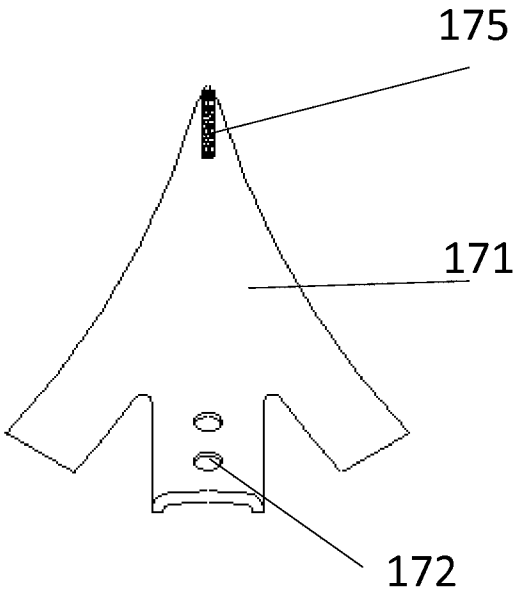
FIG. 17*a* is a top view of a sweep with nose point Caden Edge.

U.S. Pat. Appl. Pub. No. 2013/0252023 Caden Edge Welding Process shows the Caden Edge weld being applied to the bottom surface of a plow sweep blade. In combination with this bottom surface Caden Edge weld, it also enhances the wear life of the plow sweep blade to apply a Caden Edge weld to the nose tip. FIG. 17*a* is a top view of a sweep with nose point Caden Edge. The sweep 171 is affixed to the implement via the sweep attachment 172. The bottom Caden Edge 173 is shown in FIG. 15*b*. The wear improvement is the nose Caden Edge 175.

A typical sweep 171 overall length is 7 to 24 inches from nose 174 to sweep attachment 172. The nose Caden Edge would be approximately 1 to 3 inches in length from the nose 174 to the weld end.

Figure 18C:
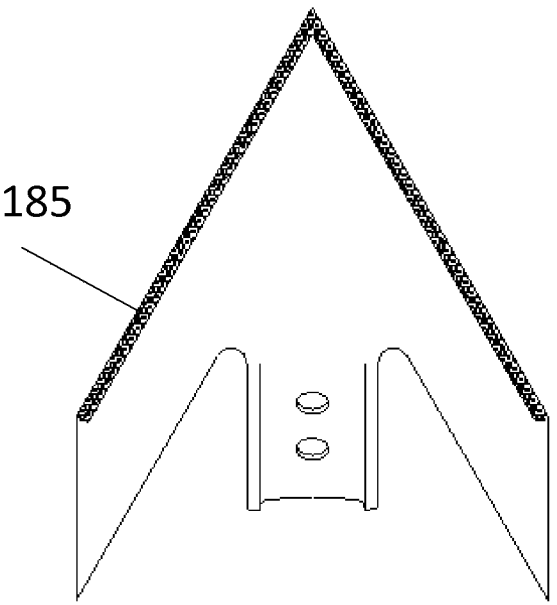
FIG. 18*c* is a bottom view of a sweep with nose point and heel Caden Edge.
Figure 18B:
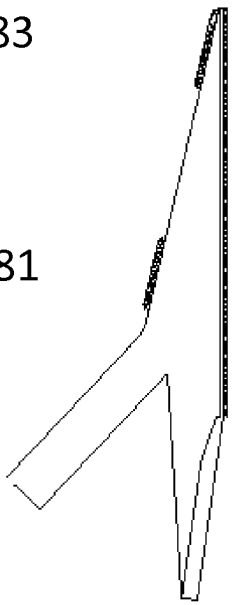
FIG. 18*b* is a side view of a sweep with nose point and heel Caden Edge.
Figure 18A:
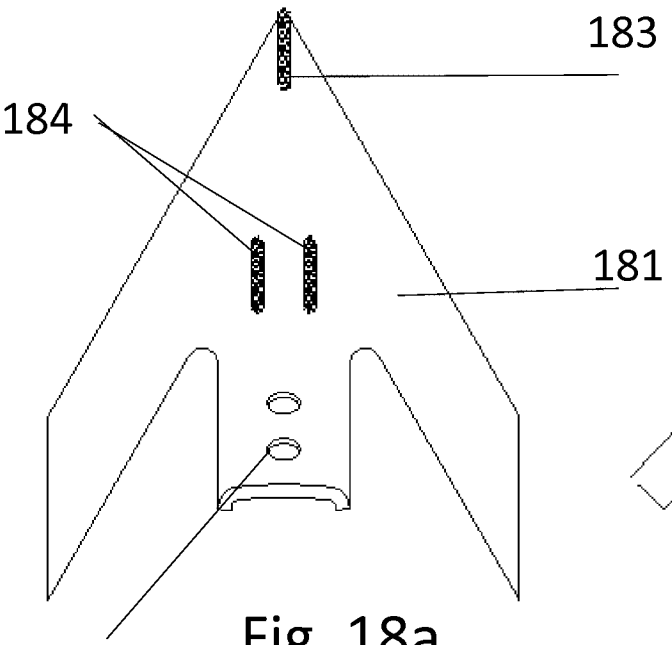
FIG. 18*a* is a top view of a sweep with nose point and heel Caden Edge.

FIG. 18*a* is a top view of a sweep with nose point and heel Caden Edge. The sweep 181 includes bottom caden edge 185, nose Caden Edge 183 and one or more shank Caden Edges 184. In this configuration, it is desired to reduce the wear on the sweep shank area. The shank Caden Edge 184 would be approximately 1 to 3 inches in length and positioned between the nose Caden Edge 183 and the sweep attachment 182.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawings and description in this disclosure are provided to help the reader understand the invention, and do not limit the scope of the claims.

The invention claimed is:

1. A hammer tip, the hammer tip comprising:

a production block comprising a body having a front side, a back side, a top working edge and an opening formed in the body and extending between the front side of the production block and the back side of the production block, the opening configured to receive a first bolt to attach the production block to a hammer; and a spacer block comprising a body having a front side, a back side and an opening formed in the body and extending between the front side of the spacer block and the back side of the spacer block, the opening configured to receive a second bolt to attach the spacer block to the hammer, wherein the production block and the spacer block each comprise a saddle back formed on their respective back sides and configured to engage with a hammer for releasable attachment thereto, wherein the production block comprises a lock pocket, the lock pocket formed as a recess along a width of the front side of the production block, and the spacer block comprises a lock ledge, the lock ledge formed as a ledge along a width of the back side of the spacer block, wherein the lock pocket of the production block is configured to matingly engage with the lock ledge of the spacer block when the production block and spacer block are attached to the hammer to hold the production block against the hammer and to prevent the production block from tilting away from the hammer when the top working edge of the production block is impacted by a grinding material.

2. The hammer tip of claim 1 wherein the top working edge of the production block includes a wear resistant coating.

3. The hammer tip of claim 1 wherein the top working edge of the production block is hardened.

4. The hammer tip of claim 1 wherein at least a portion of the front side of the production block includes a wear resistant coating.

5. The hammer tip of claim 1 wherein substantially all of the front side of the production block includes a wear resistant coating.

6. The hammer tip of claim 1 wherein the production block further comprises a pair of side working edges, the side working edges each including a wear resistant coating.

7. The hammer tip of claim 1 wherein the production block further comprises a pair of side working edges, the side working edges each being hardened.

8. The hammer tip of claim 1 wherein at least a portion of the front side of the spacer block includes a wear resistant coating.

9. The hammer tip of claim 1 wherein substantially all of the front side of the spacer block includes a wear resistant coating.

10. The hammer tip of claim 1 wherein the production block further comprises a pair of side working edges, and the top working edge and the side working edges of the production block include a wear resistant coating.

11. The hammer tip of claim 1 wherein at least a portion of the front side of the production block and at least a portion of the front side of the spacer block each include a wear resistant coating.

12. The hammer tip of claim 1 wherein substantially all of the front side of the production block and substantially all of the front side of the spacer block each include a wear resistant coating.

* * * * *